US010926146B2

(12) United States Patent
Stypka et al.

(10) Patent No.: US 10,926,146 B2
(45) Date of Patent: Feb. 23, 2021

(54) SPORTS TRAINING DEVICE FOR IMPROVING STICK HANDLING AND MANEUVERING

(71) Applicant: Eric Olafson, Wynyard (CA)

(72) Inventors: Adam Stypka, Edmonton (CA); Adam Alan Groshko, Edmonton (CA); Marek Babic, Edmonton (CA); Rajko Crnogorac, Edmonton (CA); Everett Hewitt, Edmonton (CA)

( * ) Notice: Subject to any disclaimer, the term of this patent is extended or adjusted under 35 U.S.C. 154(b) by 0 days.

(21) Appl. No.: 16/354,463

(22) Filed: Mar. 15, 2019

(65) Prior Publication Data

US 2019/0282875 A1 Sep. 19, 2019

Related U.S. Application Data

(60) Provisional application No. 62/643,988, filed on Mar. 16, 2018.

(51) Int. Cl.

| | |
|---|---|
| ***A63B 69/00*** | (2006.01) |
| ***A63B 59/70*** | (2015.01) |
| ***A63B 102/22*** | (2015.01) |
| ***A63B 102/24*** | (2015.01) |

(52) U.S. Cl.

CPC ..... *A63B 69/0024* (2013.01); *A63B 59/70* (2015.10); *A63B 2102/22* (2015.10); *A63B 2102/24* (2015.10)

(58) Field of Classification Search

CPC . A63B 69/0024; A63B 59/70; A63B 2102/22; A63B 2102/24; A63B 71/0622; A63B 2225/055; A63B 2225/50; A63B 2220/833; A63B 2071/0675; A63B 2071/0683; A63B 69/0026

See application file for complete search history.

(56) References Cited

U.S. PATENT DOCUMENTS

| | | | | |
|---|---|---|---|---|
| 6,165,084 | A | 12/2000 | Cranston | |
| 2008/0248902 | A1 | 10/2008 | Pittorf | |
| 2008/0287224 | A1 | 11/2008 | Salvador et al. | |
| 2012/0157242 | A1 | 6/2012 | Quinn | |
| 2012/0190501 | A1* | 7/2012 | Mazzanobile | A63B 69/0028 482/4 |
| 2013/0104443 | A1* | 5/2013 | Cramer | A01M 31/06 43/2 |
| 2013/0196794 | A1* | 8/2013 | Wheelbarger | A63B 69/20 473/422 |
| 2017/0095717 | A1* | 4/2017 | Simonov | A63B 69/0026 |
| 2018/0001173 | A1* | 1/2018 | Cupa | A63B 24/0084 |
| 2018/0154234 | A1* | 6/2018 | Pack | A63B 63/083 |
| 2018/0339210 | A1* | 11/2018 | Linneman | A63B 69/0026 |

* cited by examiner

*Primary Examiner* — Jeffrey S Vanderveen
(74) *Attorney, Agent, or Firm* — Field LLP

(57) ABSTRACT

A training device for improving stick handling and maneuvering includes a base mountable to a playing surface, with at least one elongate member arranged on the base and rotatable thereabout, the elongate member extending substantially parallel to the playing surface, a motor house within the base and connected to the elongate member provides rotational movement to the elongate member, the elongate member defining at least two openings between the elongate member and the playing surface, wherein rotation of the at least one elongate member serves to rotate the at least two openings, to thereby dynamically change the orientation of and access to the openings.

21 Claims, 3 Drawing Sheets

SPORTS TRAINING DEVICE FOR IMPROVING STICK HANDLING AND MANEUVERING

FIELD OF INVENTION

The present application relates to a sports training device; specifically, the present application relates to a sports training device for improving stick handling and maneuvering.

BACKGROUND

Stick handling and the ability to maneuver with a playing ball or similar objects are important skills for sports players to master. Effective stick handling and maneuvering are especially important in sports such as hockey and ringette, where a stick is used to handle a playing ball, such as a puck or ring. Those who master stick handling and maneuvering are most effective on the playing field; they can confidently handle the playing ball past opponents, through constantly changing open spaces, and into the offensive playing zone.

Stick handling and maneuvering are skills that may not always come naturally, they must be practiced. Training drills requiring a player to find open spaces on an opponent are commonly used by players to improve their stick handling skills. In ice hockey, for example, common stick handling drills include passing the puck between an opponent's legs, passing the puck between an opponent's stick and their skate, and passing the puck around the outside of an opponent, while the opponent is constantly moving. Although these drills are effective at improving stick handling and maneuvering, they require a partner to practice with, which is not always possible.

Training aids allow players to practice on their own. In the prior art training devices for practicing are presented that focus on goal scoring and maneuvering around a goaltender. For example, US Patent publication nos. 2008/0287224 and 2008/0248902 disclose a hockey stick handling device comprising cross members and support columns. The support columns elevate the cross members from a playing surface to allow an object for stick handling to be passed underneath. The cross members of the device are manually rotatable, allowing the device to be arranged in different configurations, however, in use, the device is stationary.

In other prior art the training devices are nonstationary. In U.S. Pat. No. 6,165,084 a hockey training device comprising a frame supporting two skate like and one hockey stick like member is disclosed. It is provided that the hockey stick member could be motorized. In US Patent publication no. 2012/0157242 a training device comprising a support, supporting an elongate obstacle member, resembling a hockey stick is disclosed. It is further disclosed that the hockey stick resembling member may be made to move independently through a range of positions by the addition of a mechanism for rotating the hockey stick resembling member. US patent publication no. 2017/0095717 discloses a training device that includes a base and at least two hockey sticks movably attached to the said base. The device includes at least one mechanism for actuating the hockey sticks, allowing the hockey sticks to move left to right and up and down.

Although the prior art noted above is nonstationary, the open spaces created by the device are stationary. The prior art does not include dynamic open spaces presenting a changing orientation and access to the player. As such these devices do not train for stick handling that replicates the changing open spaces of a constantly moving opponent. Since the open spaces of an opposing player are constantly changing in orientation and accessibility, the need for training devices exist that can simulate an opposing player.

SUMMARY OF INVENTION

In one aspect of the present disclosure, a training device is provided for improving stick handling and maneuvering. In particular, the device comprises at least one elongate member, housing openings to pass balls and similar objects therethrough, wherein the slots are dynamic to present a changing orientation and access to the user. Advantageously, the training device replicates the changing open spaces of a constantly moving opponent.

In another aspect, a training device for improving stick handling and maneuvering includes a base mountable to a playing surface, with at least one elongate member arranged on the base and rotatable thereabout, the elongate member extending substantially parallel to the playing surface, a motor housed within the base and connected to the elongate member provides rotational movement to the elongate member, the elongate member defining at least two openings between the elongate member and the playing surface, wherein rotation of the at least one elongate member serves to rotate the at least two openings, to thereby dynamically change the orientation of and access to the openings.

DETAILED DESCRIPTION

Figure 1:
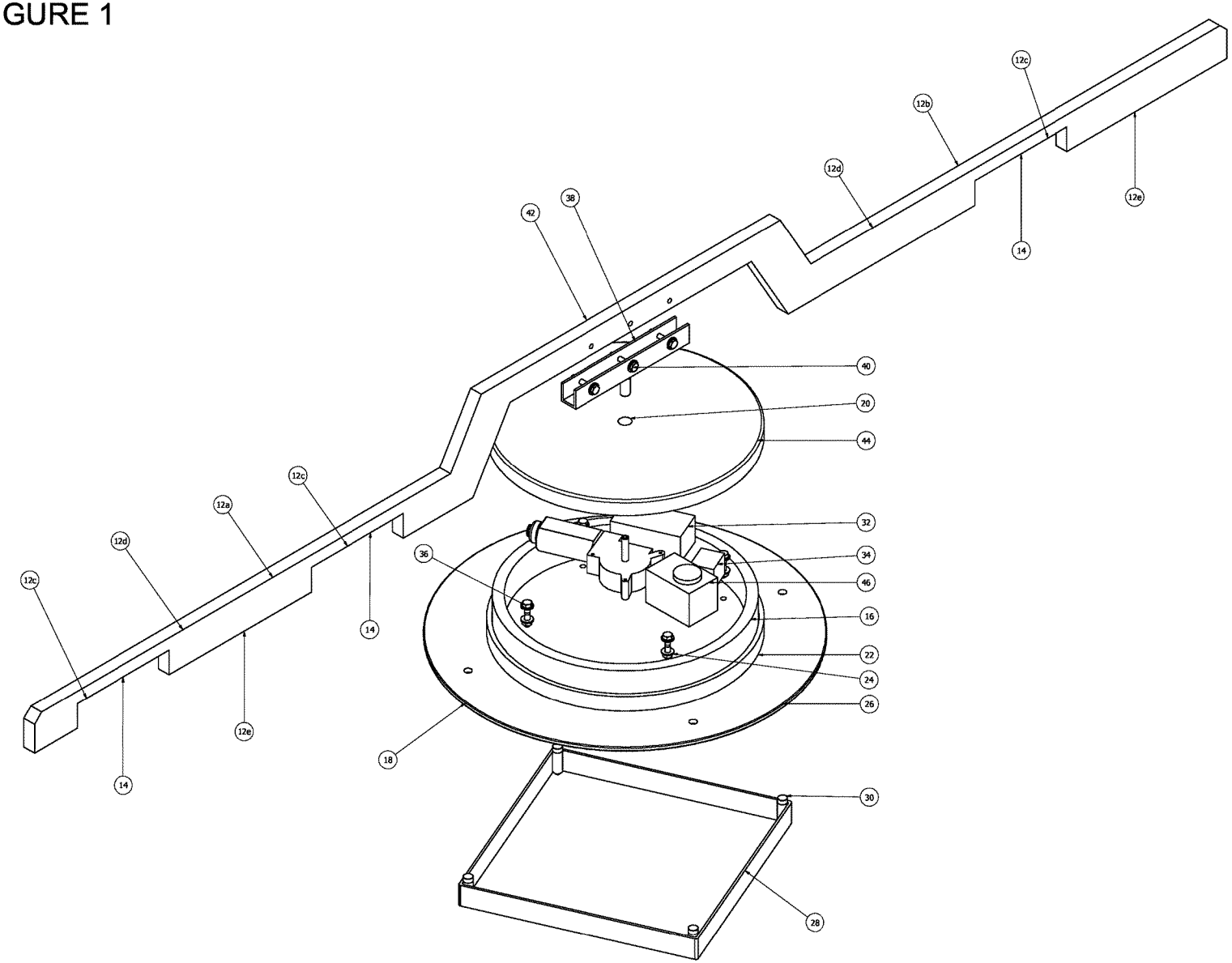
FIG. 1 is an exploded isometric view of an embodiment of the present invention.

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects.

In one aspect of the present disclosure, an embodiment of the device 10, as viewed in the Figures, includes an elongate member 12. The elongate member 12 is connected to a base 18 and rotatable thereabout, the base 18 mountable on a playing surface S. The elongate member 12 extends substantially parallel to the playing surface S, having a top edge 12*d* and a bottom edge 12*e*, the bottom edge 12*e* above the playing surface S and the top edge 12*d* above the bottom edge 12*e*. The elongate member 12 defines openings 12*c* between the elongate member 12 and the playing surface S, the openings 12*c* defined in the bottom edge 12*e*. In some embodiments, the elongate member 12 may define openings in the top edge 12*d*. In other embodiments, the elongate member 12 may have openings defined in the tope edge 12*d* and bottom edge 12*e*.

Each opening 12*c* defined by the elongate member 12 is sized such that a playing ball or similar object, for example, a puck, round ball, or ringette ring, can pass through the opening 12*c*. In some embodiments of the device 10, as shown in the Figures, each opening includes a sensor 14, which can detect a playing ball and similar object passing through the opening 12*c*. In embodiments where openings are defined in the top edge 12*d* of the elongate member 12, each opening may also include a sensor 14. The sensors 14 can be connected to a printed circuit board (PCB) module 34 housed within the base 18. Together, the sensors 14 and printed circuit board module 34 can store and optionally also transmit data relating to the number of playing balls that pass through the openings 12*c* defined by the elongate member 12. Optionally, the PCB module 34 can also transmit such data to an external unit such as a computer, tablet or smart phone. An application can then be used to review such data.

In use, when the device 10 is activated, the rotation of the elongate member 12 serves to rotate the at least two openings 12*c*, dynamically changing the orientation of and access to the openings 12*c*, replicating the changing open spaces of a constantly moving sports opponent.

It will be appreciated by a person skilled in the art that different configurations of the elongate member 12 are possible. Preferably, the elongate member 12 will define at least two openings 12*c*, the openings 12*c* preferably spaced variably along the elongate member 12, to ensure that the user of the device 10 has to move the position of the playing ball after each half rotation of the elongate member 12 in order to pass the playing ball through the opening 12*c*.

The elongate member 12 may comprise of two individual members 12*a*, 12*b*, which can each be replaced with other individual members 12*a*, 12*b* of different sizes with different configurations of openings 12*c*, thus changing the orientation of and access to the openings 12*c*, and keeping the players challenged.

It will also be appreciated by a person skilled in the art that multiple elongate members 12 and multiple openings 12*c* are possible.

Figure 2:
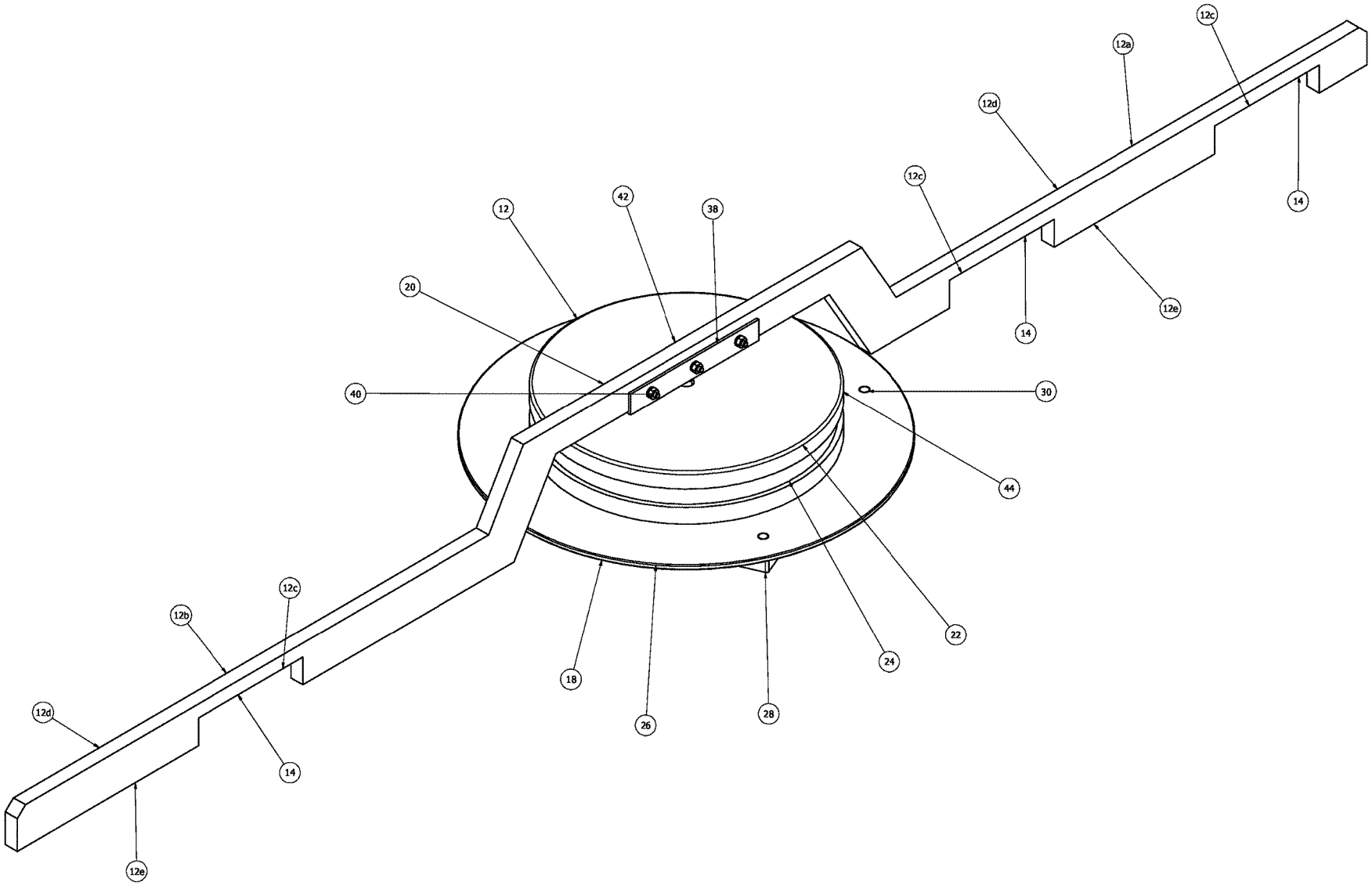
FIG. 2 is an assembled isometric view of the embodiment shown in FIG. 1.
Figure 3:
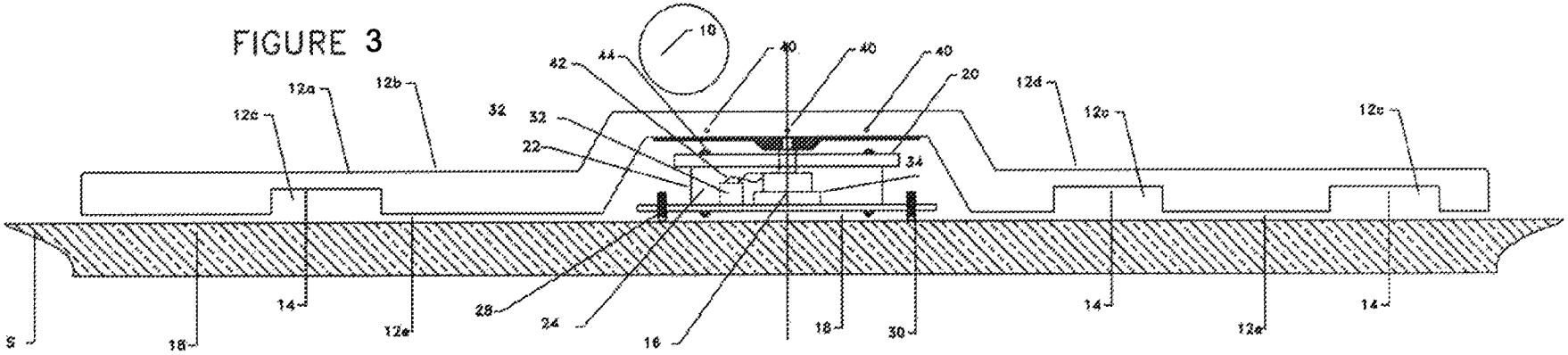
FIG. 3 is a cross sectional elevation view of the embodiment shown in FIG. 1.
Figure 4:
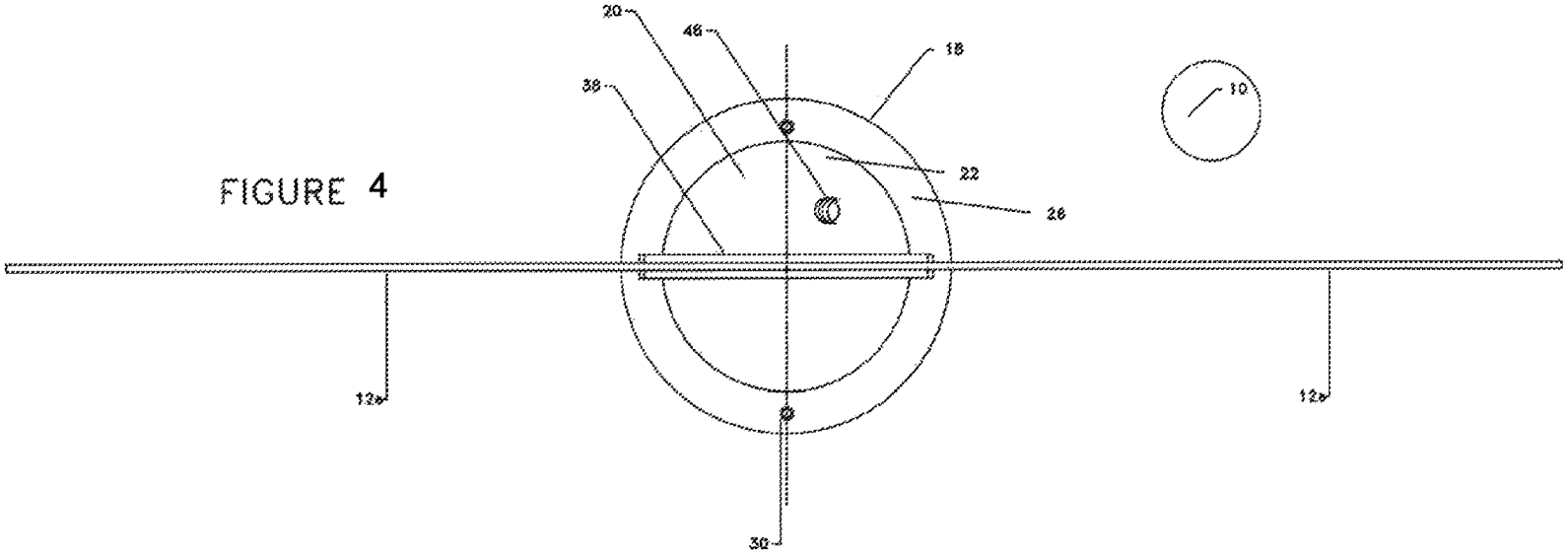
FIG. 4 is a top plan view of the embodiment shown in FIG. 1.

Optionally in some embodiments, as shown in FIGS. 1 and 2, the elongate member 12 will include an emergency auto-stop sensor 42, which serves as a safety feature, shutting of the device 10, for example, if a player falls and is in contact with the elongate member 12. The auto-stop sensor 42 detects obstructions to the elongate member 12, shutting off the device 10 if the obstruction persists for 1 or more seconds. Preferably, the obstruction must be of a minimum weight in order for it to be detected, so as to ensure an obstruction by a playing ball or similar object would not be detected by the auto-stop sensor 42.

The base 18 of the device 10 houses a motor 16, the motor 16 connectable to the elongate member 12, to provide rotational movement to the elongate member 12. The motor 16 may be powered with a battery supply 32, the battery supply 32 also housed within the base 18 of the device 10.

The base 18 of the device may comprise of a top cover 20, housing ring 22, bottom cover 24, and an assembly plate 26, as shown in the Figures. Furthermore, the top cover 20 may include an arm bracket 40, connected to the motor 16 and detachably connectable to the elongate member 12 with a bolt assembly 40, allowing the changing of different elongate member 12 types. The arm bracket 40 detachably connects the motor 16 to the elongate member 12, transferring rotational movement to the elongate member 12.

The base 18 may also comprise a shock absorption frame 28 located closest to the playing surface S as shown most clearly in FIG. 1. A resilient material is preferred for the shock absorption frame 28. However, it will be appreciated that other materials may be used to manufacture the shock absorption frame 18 and are within the scope of the present disclosure. The shock absorption frame 28 can serve to deflect the playing ball and the like off of the device 10, returning the playing ball back to the player.

The base 18 of the device is mounted to the playing surface S. Different mounting methods may be used. For playing surfaces S such as ice, grass, and turf, the base 18 may be mounted using sharpened pegs as shown in FIG. 1. For a playing surface S such as a gymnasium floor, suction cups may be used to mount the device 10 to the playing surface S.

The base 18 of the device 10 may also include an on and off switch 44 located on the top cover 20 as shown in the Figures. The device 10 may also be turned on and off remotely using a Bluetooth or infrared remote control (not shown). In some embodiments the remote control takes the form of the computer, tablet, or smart phone having an application that allows for remote turning on and off of the device.

In some embodiments of the device 10, the elongate member 12 may rotate at different speeds and in different directions. In one embodiment of the device 10, the device 10 can operate at a beginner, intermediate or advanced level. The difference in each level is the speed and number of changes in direction of the elongate member 12. The different levels may be controlled with buttons located on the top cover 20 of the base 18 or may be controlled remotely, for example by a playing coach, using the Bluetooth or infrared remote control.

The device 10 may be used by a single player. A player may position herself in front of the device 10, and practice their stick handling and maneuvering by attempting to pass the playing ball through the openings 12*c* defined by the elongate member 12, as the said elongate member 12 rotates, and present changing orientation and access of the openings 12*c* to the player. A player may also move towards the activated device 10, attempting to maneuver past the device 10, by passing the ball through the openings 12*c* defined by the elongate member 12, the device 10 replicating the changing open spaces on a constantly moving sports opponent.

The device 10 may also be used by multiple players. For example, two players may stand on opposite sides of the device 10, attempting to pass the playing ball and the like to the other player, while the orientation and access to the openings 12*c* constantly changes. In such cases, sensors 14 may be programmable to distinguish data from each opening, to record training data for each player. Alternately, the playing ball may be equipped with a marker that is sensible by the sensors 14 to detect which user has passed the playing ball through or over the opening 12*c*.

In some embodiments of the device 10, the device 10 may provide drills and coaching instructions, for example, with respect to maneuvering and passing the playing ball. The drills may be varied in level of difficulty. As it will be appreciated by a person skilled in the art, there are numerous ways and combinations in which a playing ball may be maneuvered and passed. The different levels of drills/coaching instructions may be downloaded onto the device 10 through an application, allowing a player to vary their training and continue to develop their skills. The device may transmit the coaching instructions to a Bluetooth speaker, or alternatively, may include a speaker 46, housed for example within the base 18, as seen in FIG. 1, which broadcasts the coaching instructions. The drills or instructions may also be downloaded as an application onto a computer, tablet, or smart phone and transmitted wirelessly to the Bluetooth speaker or to the device 10; or the computer, tablet, or smartphone may broadcast the instructions itself. This embodiment of the device 10 is preferred for personal use so as to simulate instructions a coach would typically provide.

The device 10 may be used in several different sports. For example, the device 10 may be used to train ice hockey, in-line hockey, ringette, and field hockey players. It will be appreciated by a person skilled in the art that different sizes and configurations of the device 10 are possible to allow the device 10 to be used in different sports. For example, if the device 10 is being used to train ice hockey players, the elongate member 12 must be elevated enough off the ice and the openings 12*c* must be large enough to allow a hockey puck to pass through the said openings 12*c*. To use the device 10 for training field hockey players, the sizes would have to be altered to allow a field hockey ball to pass through the openings 12*c*, for example, the elongate member 12 would have to be elevated higher off the playing surface S.

What is claimed is:

1. A training device, for improving stick handling and maneuvering, said device comprising:

a. a base mountable on a playing surface;

b. at least one elongate member arranged on the base and rotatable thereabout, the elongate member extending substantially parallel to the playing surface;

c. a motor housed within the base and connected to the elongate member to provide rotational movement to the elongate member; the at least two openings housing sensors for sensing a ball through the openings, d. the elongate member defining at least two openings;

wherein rotation of the at least one elongate member serves to rotate the at least two openings, to thereby dynamically change the orientation of and access to the openings.

2. The device of claim 1 wherein the sensors are in electronic communication with a printed circuit board module, housed within the base of the device.

3. The device of claim 2 wherein the printed circuit board module is adapted to transmit data to an external unit.

4. The device of claim 3 wherein the external unit is selected from a group consisting of a computer, tablet, and smart phone.

5. The device of claim 1 wherein the at least two openings are spaced variably along the elongate member.

6. The device of claim 1 wherein the elongate member is rotatable at varied speeds.

7. The device of claim 1 wherein the elongate member is rotatable clockwise and counter-clockwise.

8. The device of claim 1 wherein the elongate member is comprised of at least two individual members.

9. The device of claim 1 wherein the elongate member is releasably arranged on the base of the device.

10. The device of claim 1 wherein the device has stored therein coaching instructions and the device includes a speaker adapted to broadcast the coaching instructions.

11. The device of claim 10 wherein the speaker is housed within the base.

12. The device of claim 10 wherein the device is connected to a Bluetooth speaker for broadcasting the coaching instructions.

13. The device of claim 10 wherein the coaching instructions are downloadable onto the device via an application on an external unit.

14. The device of claim 1 wherein the base includes a resilient shock absorption frame.

15. The device of claim 1 wherein the base includes a top cover, housing ring, bottom cover, and an assembly plate.

16. The device of claim 15 wherein the bottom cover of the base includes pegs adapted to secure the device to the playing surface.

17. The device of claim 15 wherein the bottom cover of the base includes suction cups adapted to secure the device to the playing surface.

18. The device of claim 15 wherein the top cover of the base includes an on/off button.

19. The device of claim 1 wherein the device includes an emergency auto-stop sensor.

20. The device of claim 1 wherein the motor is powered with a battery supply.

21. The device of claim 20 wherein the base is adapted to house the battery supply.

* * * * *